US012702224B2

(12) United States Patent
Peters et al.

(10) Patent No.: US 12,702,224 B2
(45) Date of Patent: Aug. 11, 2026

(54) CLOSET STORAGE SYSTEM

(71) Applicant: CleverMade, LLC, Carlsbad, CA (US)

(72) Inventors: Abraham Peters, Monrovia, CA (US); Jamison Burton Miller, San Marcos, CA (US); Jennifer Catherine Sutcliffe Weiler Fimbres, Santee, CA (US)

(73) Assignee: CleverMade, LLC, Carlsbad, CA (US)

( * ) Notice: Subject to any disclaimer, the term of this patent is extended or adjusted under 35 U.S.C. 154(b) by 248 days.

(21) Appl. No.: 18/413,815

(22) Filed: Jan. 16, 2024

(65) Prior Publication Data

US 2024/0237819 A1 Jul. 18, 2024

Related U.S. Application Data

(60) Provisional application No. 63/480,273, filed on Jan. 17, 2023.

(51) Int. Cl.
*A47B 47/00* (2006.01)
*A47B 43/00* (2006.01)
(Continued)

(52) U.S. Cl.
CPC ..... *A47B 47/0091* (2013.01); *A47B 43/003* (2013.01); *A47B 45/00* (2013.01); *A47B 87/0207* (2013.01); *A47B 87/0276* (2013.01)

(58) Field of Classification Search
CPC ... A47B 47/0091; A47B 45/00; A47B 96/024; A47B 47/047; A47B 87/02; A47B 43/04;
(Continued)

(56) References Cited

U.S. PATENT DOCUMENTS 2,733,112 A * 1/1956 Dunham ..... A47B 87/02 206/509
3,042,220 A * 7/1962 Jakobsson ..... A47B 47/047 211/90.04
(Continued)

FOREIGN PATENT DOCUMENTS

JP H05253042 A 10/1993
KR 20220136641 A 11/2022

OTHER PUBLICATIONS

CleverMade. Quick-Adjust Shelving System. Vimeo video, <https://vimeo.com/417683905/6150801809>, Disclosed Jul. 2020. Representative screenshots taken at 5 seconds, 15 seconds, and 21 seconds. 4 pages.
(Continued)

*Primary Examiner* — Hiwot E Tefera
(74) *Attorney, Agent, or Firm* — Sheppard Mullin Richter & Hampton LLP

(57) ABSTRACT

A shelf system may include a first shelf module having attachment features for connecting the first shelf module to a second shelf module, such that the first shelf module can support the second shelf module in a hanging configuration, or the second shelf module can support the first shelf module in a freestanding configuration. The shelf modules may include a plurality of panels that may be foldable or capable of assembly into a form having a container space inside and a lid portion positionable to selectively cover or reveal the container space. Multiple shelf modules may be connected or stacked to customize the number of storage spaces for various items.

19 Claims, 5 Drawing Sheets

(51) Int. Cl.
*A47B 45/00* (2006.01)
*A47B 87/02* (2006.01)

(58) Field of Classification Search
CPC ... A47B 61/003; A47B 73/006; A47B 43/003; A47B 61/04; A47B 87/0207; A47B 87/0276; A45C 3/02
See application file for complete search history.

(56) References Cited

U.S. PATENT DOCUMENTS 3,472,476 A 10/1969 Johnson
3,980,162 A * 9/1976 Dvorak ..... A45C 3/02 190/125
4,232,916 A * 11/1980 Correia ..... A47B 87/0207 312/265.5
4,561,706 A * 12/1985 Grati ..... A47B 43/02 312/258
5,272,991 A 12/1993 Carrigan
5,415,302 A 5/1995 Carlson et al.
5,445,397 A * 8/1995 Evans ..... B62B 1/10 206/508
5,531,167 A 7/1996 Stevens et al.
5,823,359 A * 10/1998 Harris ..... B42F 7/12 211/11
6,092,672 A * 7/2000 Harris ..... B42F 7/10 211/11
6,240,856 B1 6/2001 Paskey
7,494,019 B2 2/2009 Kessell
8,042,477 B2 10/2011 Lee
8,646,624 B2 2/2014 Fernandez
D702,541 S 4/2014 Mansor
10,299,588 B1 5/2019 Lai
10,827,833 B2 11/2020 Romantic
D942,561 S 2/2022 Dunahay
11,415,159 B2 8/2022 Ronda
D984,835 S 5/2023 Hanlon
D997,267 S 8/2023 Dunahay
D997,696 S 9/2023 Yang
D1,008,381 S 12/2023 Dunahay
D1,008,382 S 12/2023 Dunahay
D1,036,235 S 7/2024 Carlson et al.
2004/0155160 A1 8/2004 Welch et al.
2006/0027475 A1* 2/2006 Gleason ..... B25H 3/021 190/110
2006/0042522 A1 3/2006 Trubiano
2006/0152114 A1* 7/2006 Yamada ..... A47B 87/02 312/107
2008/0203040 A1 8/2008 Kologe
2009/0152225 A1 6/2009 Lee
2009/0184076 A1 7/2009 Lee
2009/0184078 A1 7/2009 Lee
2009/0289069 A1* 11/2009 Logan ..... A47B 43/04 220/495.1
2010/0038330 A1* 2/2010 Zu ..... A47F 7/146 211/183
2012/0074158 A1* 3/2012 Lafleur ..... B65D 43/164 220/810
2014/0130837 A1 5/2014 Sy-Facunda
2015/0196121 A1* 7/2015 Chan ..... A47B 87/0276 312/107
2017/0079426 A1* 3/2017 Davis ..... B65D 21/0212
2017/0234344 A1 8/2017 Edman
2018/0066428 A1 3/2018 Diekroger
2018/0325257 A1 11/2018 Xiang
2019/0331288 A1 10/2019 Gupta
2021/0147135 A1* 5/2021 Rogers ..... B65D 81/3897
2022/0049518 A1 2/2022 Pruitt
2022/0110424 A1* 4/2022 Rodgers ..... A45C 3/001
2023/0200530 A1 6/2023 Carlson et al.

OTHER PUBLICATIONS

CleverMade. Quick-Adjust Shelving System. Disclosed May 26, 2020. 6 pages.
International Preliminary Report on Patentability mailed May 23, 2024 in International Patent Application No. PCT/US22/49725, 9 pages.
International Search Report and Written Opinion mailed Feb. 14, 2023 in International Patent Application No. PCT/US22/49725, 17 pages.
Quick Adjust Shelving System by CleverMade. Vimeo video, <https://vimeo.com/435192044/bfb209e51a>, Disclosed Jul. 2020. Screenshots taken at 5 seconds, 18 seconds, and 21 seconds. 4 pages.

* cited by examiner

CLOSET STORAGE SYSTEM

CROSS-REFERENCE TO RELATED APPLICATION(S)

The present application claims priority to U.S. Provisional Patent Application No. 63/480,273, filed Jan. 17, 2023, which is incorporated herein by reference in its entirety.

TECHNICAL FIELD

The present disclosure is directed generally to closet storage systems, and associated systems and methods.

BACKGROUND

Conventional closets include a horizontal pole for supporting hangers or other items. Because conventional closets often require clothes to be positioned side-by-side in a horizontal manner, the available space along the pole may be fully occupied while vertical space may not be fully utilized. Accordingly, conventional closet storage systems (such as hangers) are inefficient, especially when closet space is already limited. Some have attempted to overcome this inefficiency by providing a shelf or pocket device that hangs vertically from the pole/rod. Such a shelf/pocket device may allow a user to use more closet space by holding more items on the shelves or in the pockets than would otherwise be able to be stored exclusively horizontally. However, existing shelf/pocket devices suffer from a number of drawbacks, such as insufficient rigidity, being open to dust or debris, or being too short or too long to be useful.

Embodiments of the present technology are directed to resolving these challenges and other challenges.

BRIEF DESCRIPTION OF THE DRAWINGS

In the drawings, wherein the same reference number indicates the same element throughout the several views.

DETAILED DESCRIPTION

Figure 1:
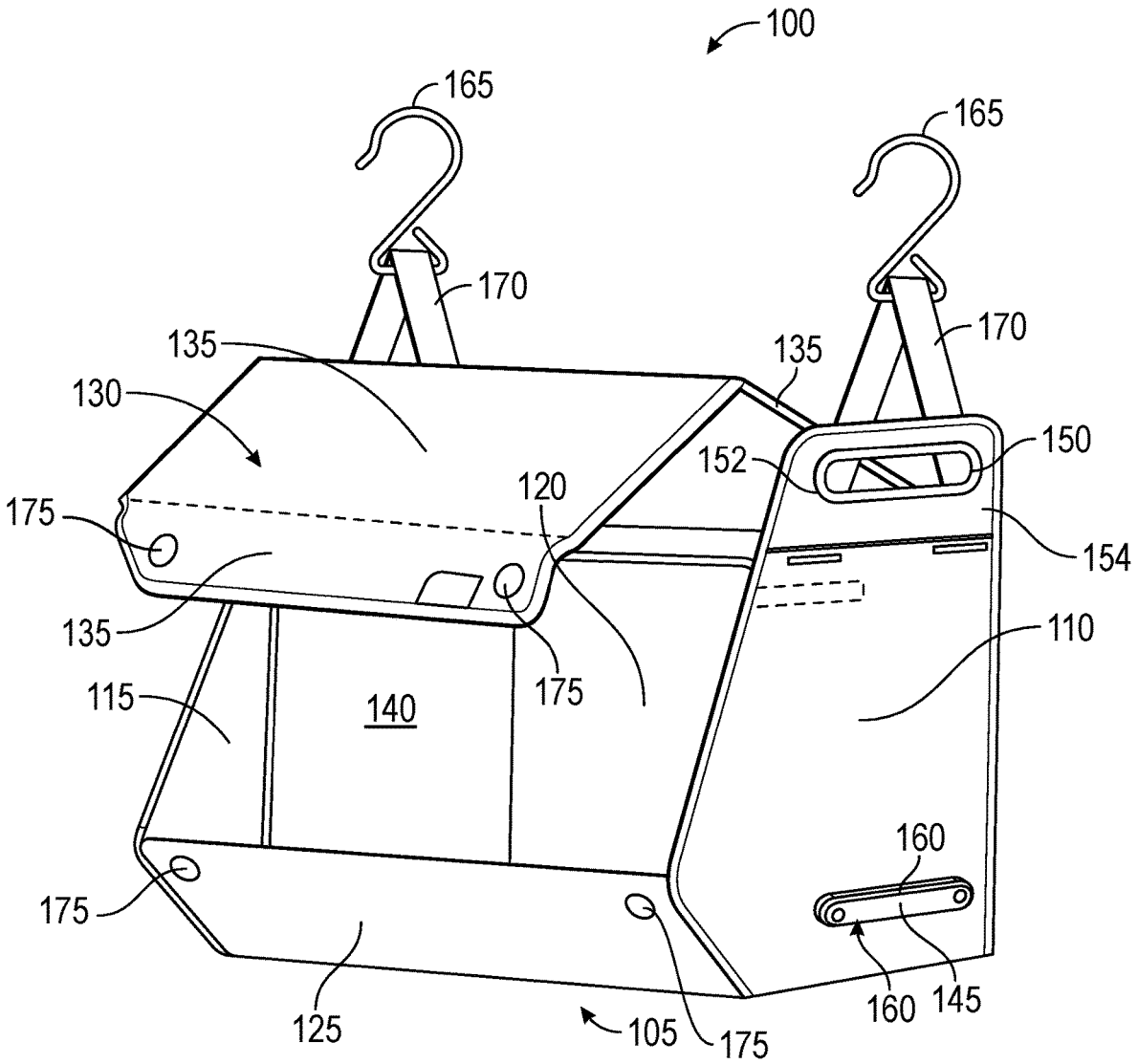
FIG. 1 illustrates a perspective view of a shelf module configured in accordance with embodiments of the present technology.

The present technology is directed to closet storage systems, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. Accordingly, embodiments of the present technology may include additional elements or exclude some of the elements described below with reference to FIGS. 1-5, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Embodiments of the present technology include closet storage systems with modular shelf units (which may be called "pods") that are interconnectable to one another so that a user may customize the quantity of shelf units in the assembly. The shelf units may be connected (e.g., stacked) and supported on a surface beneath the connected shelf units to form a freestanding shelf system, or they may be hung from a support above the connected shelf units, such as a closet rail. Embodiments of the present technology are advantageous at least because they allow a user to select an appropriate or desired quantity of modular shelf units for storage of items, they allow a user to customize the overall length or height of the storage system, they provide enclosed areas covered by lids to keep out dust and debris, and they have a generally rigid structure (e.g., the panels disclosed below may be generally rigid) for resisting collapsing or crushing. Although many embodiments are applicable to storage in closets, embodiments of the present technology are not limited to storage in closets, and may be implemented in cabinets or anywhere storage is desired.

A representative system may include a pod having a first side, a second side opposite the first side, a rear side, a bottom side, a front side, and a top lid portion, wherein the sides and the lid portion enclose a space, and wherein the lid portion articulates relative to the remainder of the pod to enable opening and closing of the lid portion, and wherein the lid portion and the front side are releasably connectable via a connection such as a magnetic connection or another suitable connection device, and wherein the first side and the second side have openings forming handles, and wherein each opening is configured to receive an attachment device to connect the pod to another pod carrying the attachment device, and wherein the first side and the second side each comprise their own attachment devices for connecting to openings on another pod's sides. A closet storage system may include one pod having hanger or closet hooks for supporting the pod in the closet, and it may optionally include additional pods hanging beneath the pod.

Another representative system may include a first shelf module, the first shelf module having: a bottom panel; a first side panel extending transversely and upwardly from the bottom panel, the first side panel carrying a first attachment feature; a second side panel extending transversely and upwardly from the bottom panel, the second side panel carrying a second attachment feature; a rear panel extending transversely and upwardly from the bottom panel, the rear panel extending transversely between the first side panel and the second side panel; a front panel extending transversely and upwardly from the bottom panel; and a lid portion including one or more lid panels movably attached to the rear panel. The lid portion may be movable between a first configuration in which the lid portion is open to expose a container space between the bottom panel, the first side panel, the second side panel, the rear panel, and the one or more lid panels, and a second configuration in which the lid portion is closed to enclose the container space. The first attachment feature and the second attachment feature may be positioned and configured to engage additional attachment features on a second shelf module to hang the second shelf module from the first shelf module or to support the first shelf module on the second shelf module.

FIG. 1 illustrates a perspective view of a shelf module 100 configured in accordance with embodiments of the present technology. In some embodiments, the shelf module 100 may include a bottom panel 105 (not clearly visible in FIG. 1, but understood to be on the bottom), a first side panel 110 extending transversely and upwardly from the bottom panel 105, a second side panel 115 extending transversely and upwardly from the bottom panel 105, a rear panel 120 extending transversely and upwardly from the bottom panel 105, and/or a front panel 125 extending transversely and upwardly from the bottom panel 105. The rear panel 120 may extend transversely between the first side panel 110 and the second side panel 115 and/or it may connect the first side panel 110 to the second side panel 115. The panels may include any suitable generally rigid material, such as a rigid foam material and/or a backing board optionally covered in an aesthetically pleasing material.

The shelf module 100 may further include a lid portion 130 comprising one or more lid panels 135 movably attached to the rear panel 120, wherein the lid portion 130 is movable and/or flexible between a first configuration in which the lid portion 130 is open to expose a container space 140 between the bottom panel 105, the first side panel 110, the second side panel 115, the rear panel 120, and the one or more lid panels 135, and a second configuration in which the lid portion 130 is closed to enclose the container space 140. FIG. 1 shows an example first/open configuration, although the lid portion 130 may be opened even further in some embodiments. Although FIG. 1 shows an outside portion of the first panel 110, the shelf module 100 may be symmetrical such that the outside portion of the second panel 115 is similar. In some embodiments, the front panel 125 may be oriented at an oblique angle or another suitable angle relative to the bottom panel 105, such that in some embodiments, the front panel 125 may extend away from the rear panel 120 to form a lip of the shelf module 100.

In some embodiments, the panels may be connected or connectable to each other and shipped and/or stored in a flat and/or stacked configuration for a user and/or retailer to assemble. In other embodiments, the shelf module 100 may be assembled at a factory. Each shelf module may be approximately 12.5 inches along a width defined by the distanced between the outer surfaces of the side panels 110, 115, approximately 14 inches tall between the bottom of the side panels 110, 115 and the top of the side panels 110, 115 (when the side panels are not folded over), and/or approximately 12.5 inches deep from front to back, although these dimensions are for example only and embodiments of the present technology may have other suitable dimensions.

In some embodiments, each of the first side panel 110 and the second side panel 115 may include a first attachment feature 145 and/or a second attachment feature 150. The first attachment features 145 on one shelf module 100 may be configured to mate with the second attachment features 150 on another shelf module 100, as described in further detail below in connection with other figures. The attachment features 145, 150 facilitate hanging shelf modules from each other or stacking shelf modules upon each other. In some embodiments, the first attachment features 145 project outwardly from the first side panel 110 and the second side panel 115 (e.g., away from the container space 140). In some embodiments, the second attachment features 150 comprise receptacles (e.g., openings surrounded by an enclosed boundary 152 made of a suitable material, such as slots formed in the side panels) for receiving the first attachment features 145. The second attachment features 150 may also form at least part of one or more handles 154 for the shelf module 100. In some embodiments, the first attachment features 145 include hook elements or flanged strips of material such as elongated bar elements 155 having a notch 160 extending along a length of the bar element, on both top and bottom sides of the bar element, as described in additional detail below. The second attachment features 150 of another shelf module may engage the notch for hanging or stacking the modules.

In some embodiments, the shelf module 100 may further include one or more hook elements 165 (e.g., two hook elements 165) extending from the shelf module 100 and positionable to receive a closet rod or a clothesline to hang the shelf module 100 from the closet rod or clothesline. In some embodiments, one of two hook elements 165 is connected to the first side panel 110 and another of the two hook elements 165 is connected to the second side panel 115 of the shelf module 100 via one or more straps 170. Using multiple hook elements 165 spaced apart from each other is advantageous to providing stability when the shelf module 100 is hanging from a closet rod or clothesline. The straps 170 may include a webbing material or another material suitable for connecting the hook elements to the side panels.

In some embodiments, the lid portion 130 and/or the front panel 125 comprises securing features 175 for securing the lid portion 130 to the front panel 125, such as magnets or other suitable securing features. The shelf module 100, including the panels, may be formed with any suitable materials, including plastic materials, fabric materials, or other materials capable of providing flexibility and/or rigidity while providing suitable support for contents of the shelf module 100, which may include clothes, shoes, other apparel, various household objects, grooming products, and/or other items.

Figure 2A:
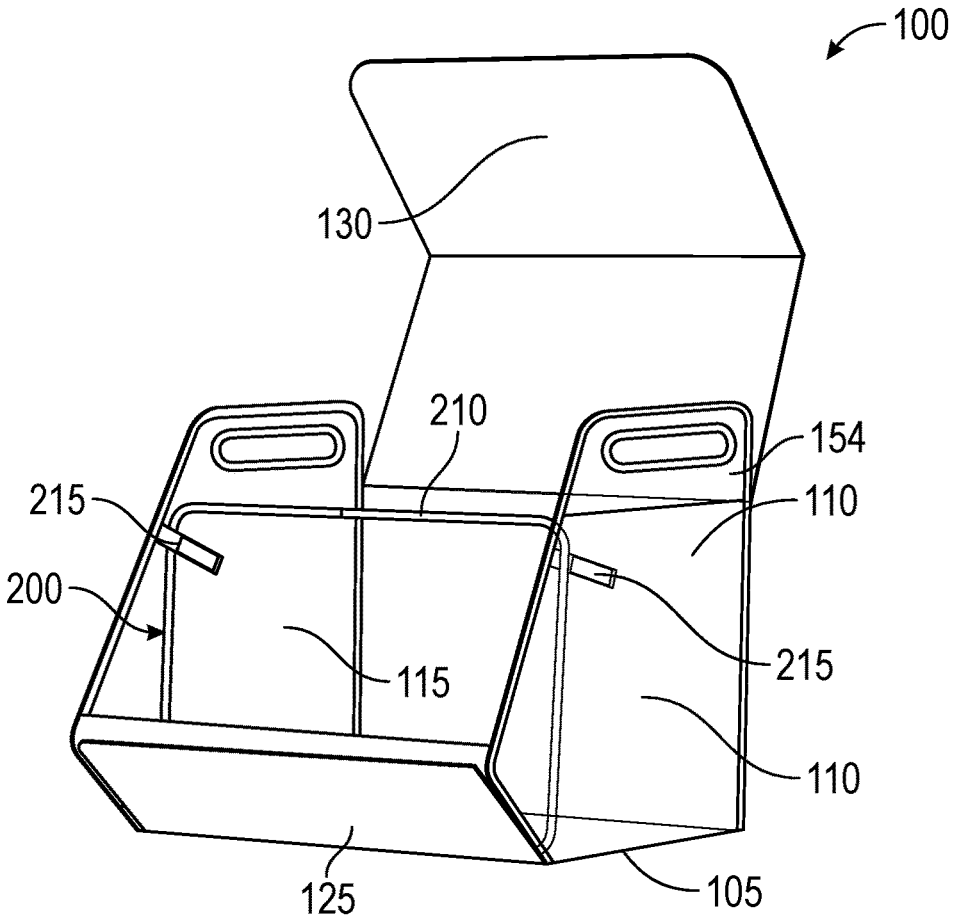
FIG. 2A illustrates a perspective view of a portion of the shelf module shown in FIG. 1, with the lid open.
Figure 2B:
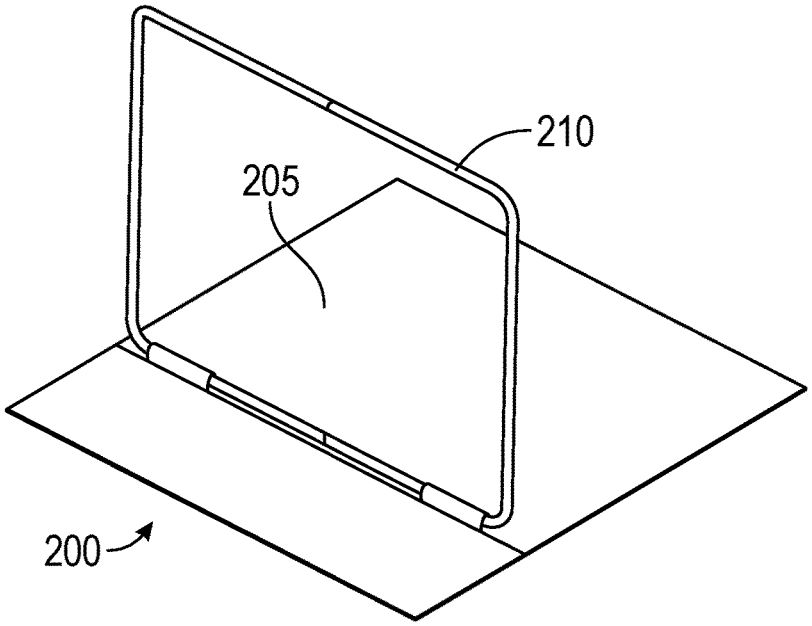
FIG. 2B illustrates a perspective view of a padded insert for installation in the shelf module, in accordance with embodiments of the present technology.

FIG. 2A illustrates a perspective view of a portion of the shelf module 100 shown in FIG. 1, with the lid portion 130 open. The first side panel 110 is shown in a transparent view to show the bottom panel 105. In some embodiments, the shelf module 100 may include a removable structural assembly 200 (e.g., a padded insert) for providing structural support for the first side panel 110 and/or the second side panel 115 relative to the bottom panel 105. The removable structural assembly 200 may also provide structure for the bottom panel 105, which in some embodiments, may not have its own structural support and may simply be a fabric or other material. FIG. 2B illustrates a perspective view of the removable structural assembly 200 for installation in the shelf module 100, in accordance with embodiments of the present technology. In some embodiments, the removable structural assembly 200 may include a base panel 205 (which may be flexible and/or bendable at a joint between multiple sub-panels of the base panel) and a rigid frame portion 210 pivotably attached to the base panel 205 (e.g., at a location where the base panel 205 may bend). The rigid frame portion 210 may be pivotable between a first position (e.g., as shown in FIG. 2B) in which the rigid frame portion 210 extends away from the base panel 205, and a second position different from the first position (such as laying flat against the base panel 205 for storage). The rigid frame portion 210 is positionable to support the first side panel 110 and/or the second side panel 115 via connections 215 to the side panels, such as hook and loop fasteners, straps, and/or other suitable fasteners. The rigid frame portion 210 may be formed with plastic, metal, or another suitable rigid or mostly rigid material.

Figure 3:
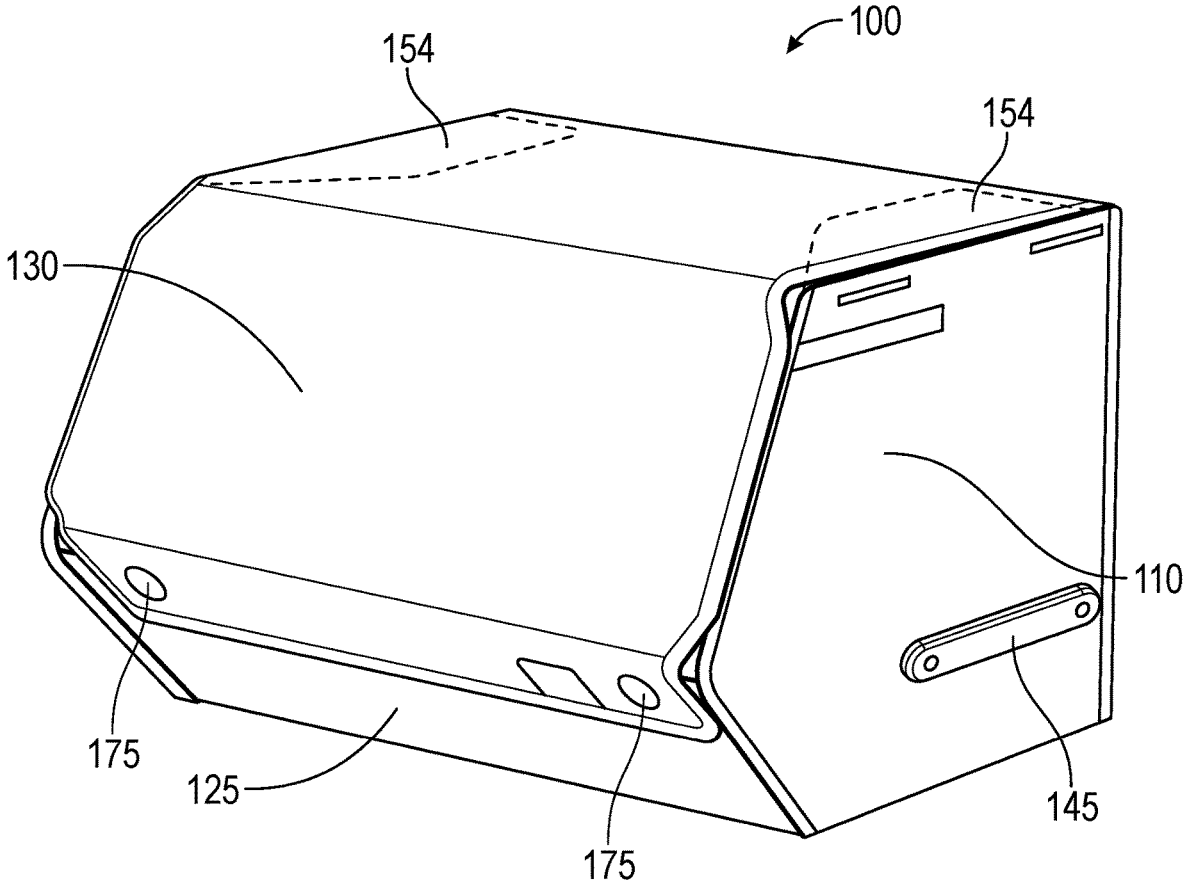
FIG. 3 illustrates a perspective view of the shelf module shown in FIG. 1, in another configuration (with the lid closed)

FIG. 3 illustrates a perspective view of the shelf module 100 shown in FIG. 1, in another configuration (e.g., a closed lid portion 130). In some embodiments, the lid portion 130 overlaps the front panel 125 when the lid portion 130 is in the second (closed) configuration. The lid portion 130 may be releasably secured to the front panel 125 via the securing features 175 (e.g., magnets, or magnets and metal elements). In some embodiments, the handles 154 may be folded or tucked into the interior of the shelf module 100 for a cleaner appearance, e.g., when the shelf module 100 is used in a free-standing manner and not hung from a shelf. In FIG. 3, the handles 154 are concealed by the lid portion 130 but shown schematically with dashed lines to illustrate their folded location. The handles 154 may be pivotable relative to their respective side panels 110, 115 to be positionable in the container space, beneath the lid portion 130, when the lid portion 130 is in the second configuration. In some embodiments, when the lid portion 130 is in the second configuration (e.g., closed), and the handles 154 are not folded into the shelf module 100, the lid portion 130 may be positioned below the tops of the side panels 110, 115 and/or below the second attachment features 150 (as is easily understood from viewing FIGS. 1 and 3).

Figure 4A:
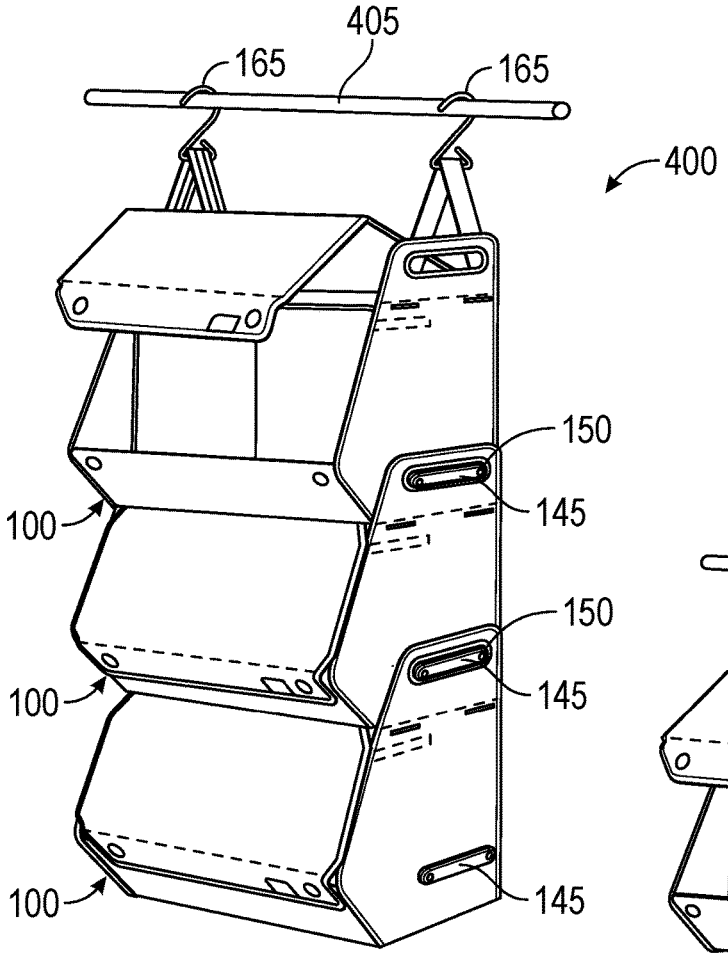
FIG. 4A illustrates a perspective view of a plurality of shelf modules, forming a shelf assembly, in accordance with embodiments of the present technology.
Figure 4B:
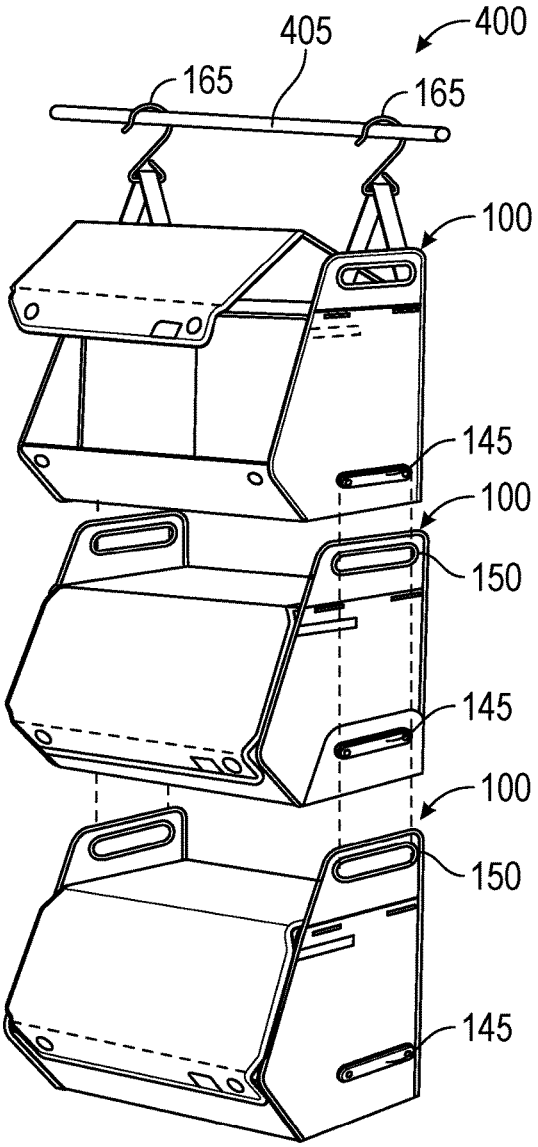
FIG. 4B illustrates an exploded view of the shelf assembly shown in FIG. 4A.

FIG. 4A illustrates a perspective view of a plurality of shelf modules 100, forming a shelf assembly 400, in accordance with embodiments of the present technology. FIG. 4B illustrates an exploded view of the shelf assembly 400 shown in FIG. 4A. The first attachment features 145 and the second attachment features 150 may facilitate stacking the modules 100 and/or hanging the modules 100 beneath other shelf modules 100. In some embodiments, the shelf assembly 400 may hang from a support structure 405, such as a closet rail, via the hook elements 165.

Figure 5:
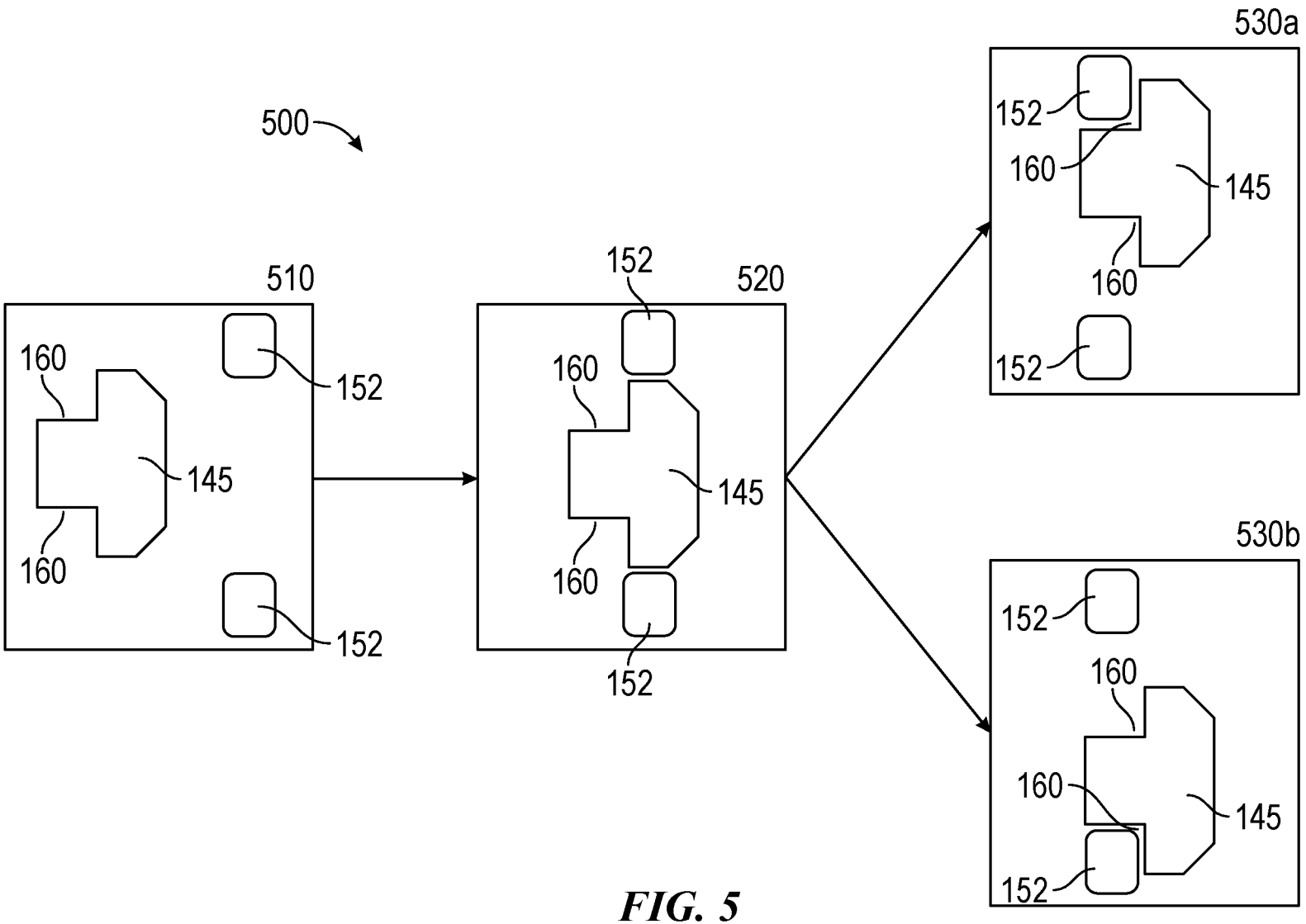
FIG. 5 schematically illustrates a method for connecting two shelf modules.

FIG. 5 schematically illustrates a method 500 for connecting two shelf modules 100. At block 510, a cross-section of a first attachment feature 145 is visible. The first attachment feature 145 may be in the form of a flanged element having the notches 160 on the top and bottom. The boundary 152 of a second attachment feature 150 may be moved toward the first attachment feature 145. Then, at block 520, the first attachment feature 145 may be passed into the boundary 152. Then, at block 530*a*, for a hanging connection, the top boundary 152 may rest in the top notch 160, such that the second attachment feature 150 hangs from the first attachment feature 145. Alternatively from block 530*a*, at block 530*b*, the bottom notch 160 may rest on the boundary 152, such that the second attachment feature 150 supports the first attachment feature 145, forming a stacked assembly of shelf modules 100 that may be freestanding.

Some embodiments of the present technology include kits of parts for closet storage systems. Kits of parts may include some or all of the elements of closet storage systems, and/or shelf modules disclosed herein, whether the parts are separate or combined with one another. For example, a kit of parts may include one or more panels, one or more hooks, one or more attachment features and/or other components or combinations of components disclosed herein. A kit of parts may include flat, stacked, and/or folded panels for shipping in a disassembled or stowed configuration.

From the foregoing, it will be appreciated that specific embodiments of the presently disclosed technology have been described herein for purposes of illustration, but that various modifications may be made without deviating from the scope of the technology. For example, the panels may be attached to each other in any suitable manner. In some embodiments, one or more panels may be stackable and/or foldable relative to other panels prior to assembly by a user for compact shipping to a user (e.g., shipping a stack of panels instead of an assembled pod). In some embodiments, the hook or elongated bar attachment element may be positionally switched with the opening.

Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

Where the context permits, singular or plural terms may also include the plural or singular term, respectively. Unless otherwise specified, terms such as "attached" or "connected" are intended to include integral connections, as well as connections between physically separate components. As used herein, the term "and/or" when used in the phrase "A and/or B" means "A, or B, or both A and B." A similar manner of interpretation applies to the term "and/or" when used in a list of more than two terms. As used herein, the terms "generally" and "approximately" refer to values or characteristics within a range of ±10% from the stated value or characteristic, unless otherwise indicated. Numerical adjectives including "first" and "second," or the like, as used in the present disclosure, do not convey hierarchy or specific features or functions. Rather, such numerical adjectives are intended to aid the reader in distinguishing between elements which may have similar nomenclature, but which may differ in position, orientation, or structure. To the extent any materials incorporated herein by reference conflict with the present disclosure, the present disclosure controls.

What is claimed is:

1. A shelf system comprising two or more shelf modules, wherein each shelf module comprises:

a bottom panel;

a first side panel extendable transversely and upwardly from the bottom panel;

a second side panel extendable transversely and upwardly from the bottom panel;

a rear panel extendable transversely and upwardly from the bottom panel, the rear panel further being extendable transversely between the first side panel and the second side panel;

a front panel extendable transversely and upwardly from the bottom panel; and a lid portion comprising one or more lid panels movably attached to the rear panel, wherein the lid portion is movable between a first configuration in which the lid portion is open to expose a container space between the bottom panel, the first side panel, the second side panel, the rear panel, and the one or more lid panels, and a second configuration in which the lid portion is closed to enclose the container space; and wherein, for a first one of the shelf modules, each of the first side panel and the second side panel includes a first attachment feature, and for a second one of the shelf modules, each of the first side panel and the second side panel includes a second attachment feature configured to mate with the first attachment feature, wherein the first attachment features comprise hook elements, and the second attachment features comprise openings in the first side panel and in the second side panel of the second shelf module, wherein at least one of the hook elements comprises an elongated bar having a notch extending along a length of the bar, and at least one the first side panel or the second side panel of the second shelf module engages the notch, and wherein when the first attachment feature is mated with the second attachment feature, the second one of the shelf modules is hangable from the first one of the shelf modules and the first one of the shelf modules is supportable on the second one of the shelf modules.

2. The shelf system of claim 1, wherein the first attachment features project outwardly from the first side panel and the second side panel, away from the container space, and wherein the second attachment features comprise receptacles for receiving the first attachment features.

3. The shelf system of claim 1, wherein the second attachment features form at least portions of handles for the second shelf module.

4. The shelf system of claim 1, wherein the lid portion overlaps the front panel when the lid portion is in the second configuration.

5. The shelf system of claim 1, wherein at least one of the lid portion or the front panel comprises securing features for securing the lid portion to the front panel.

6. The shelf system of claim 5, wherein the securing features comprise magnets.

7. The shelf system of claim 1, wherein when the lid portion is in the second configuration, the lid portion is positioned below the second attachment features.

8. The shelf system of claim 1, further comprising one or more hook elements extending from the first shelf module and positionable to receive a closet rod or a clothesline to hang the first shelf module from the closet rod or clothesline.

9. The shelf system of claim 8, wherein the one or more hook elements are connected to the first side panel and the second side panel of the first shelf module via one or more straps.

10. The shelf system of claim 1, wherein the front panel is oriented at an oblique angle relative to the bottom panel and extends away from the rear panel.

11. The shelf system of claim 1, wherein the second attachment features form handles for carrying the second shelf module, and wherein the handles are pivotable relative to the first side panel and the second side panel to be positioned in the container space, beneath the lid portion, when the lid portion is in the second configuration.

12. The system of claim 1, wherein:

at least one of the shelf modules comprises a removable structural assembly comprising a base panel and a rigid frame portion pivotably attached to the base panel;

the rigid frame portion is pivotable between a first position in which the rigid frame portion extends away from the base panel, and a second position different from the first position; and the rigid frame portion is positionable to support the first side panel and the second side panel.

13. A shelf system comprising a first shelf module, the first shelf module comprising:

a bottom panel;

a first side panel extending transversely and upwardly from the bottom panel, the first side panel carrying a first attachment feature;

a second side panel extending transversely and upwardly from the bottom panel, the second side panel carrying a second attachment feature;

a rear panel extending transversely and upwardly from the bottom panel, the rear panel extending transversely between the first side panel and the second side panel;

a front panel extending transversely and upwardly from the bottom panel; and a lid portion comprising one or more lid panels movably attached to the rear panel, wherein the lid portion is movable between a first configuration in which the lid portion is open to expose a container space between the bottom panel, the first side panel, the second side panel, the rear panel, and the one or more lid panels, and a second configuration in which the lid portion is closed to enclose the container space;

wherein the first attachment feature and the second attachment feature are positioned and configured to engage additional attachment features on a second shelf module to hang the second shelf module from the first shelf module or to support the first shelf module on the second shelf module, wherein the additional attachment features comprise openings in side panels of the second shelf module, and wherein each of the first attachment feature and the second attachment feature comprises an elongated bar having a notch extending along a length of the bar, the openings are configured to receive the notches, and the notches are configured to receive boundaries of the openings.

14. The shelf system of claim 13, further comprising the second shelf module.

15. The shelf system of claim 14, wherein each of the openings comprises an enclosed boundary.

16. The shelf system of claim 13, wherein the lid portion overlaps the front panel when the lid portion is in the second configuration.

17. The shelf system of claim 13, further comprising a first hook element connected to the first side panel, and a second hook element connected to the second side panel, wherein the first hook element and the second hook element are configured and positionable to hook onto a hanging rod or clothesline.

18. The shelf system of claim 13, wherein the front panel is oriented at an oblique angle relative to the bottom panel and extends away from the rear panel.

19. The shelf system of claim 13, further comprising handles for carrying the first shelf module, and wherein the handles are pivotable relative to the first side panel and the second side panel to be positioned in the container space, beneath the lid portion, when the lid portion is in the second configuration.

* * * * *